US006574960B2

(12) United States Patent
Kleibrink

(10) Patent No.: US 6,574,960 B2
(45) Date of Patent: Jun. 10, 2003

(54) METHOD AND APPARATUS FOR MAINTAINING THE CORRECT OIL OVERFLOW QUANTITY IN DIAPHRAGM COMPRESSORS

(76) Inventor: Horst Kleibrink, Heisenbergstr. 16, 45473 Muelheim-Ruhr (DE)

( * ) Notice: Subject to any disclaimer, the term of this patent is extended or adjusted under 35 U.S.C. 154(b) by 0 days.

(21) Appl. No.: 10/004,397

(22) Filed: Nov. 15, 2001

(65) Prior Publication Data

US 2002/0056366 A1 May 16, 2002

(30) Foreign Application Priority Data

Nov. 15, 2000 (DE) ..... 100 56 568

(51) Int. Cl.[7] ..... B60T 11/26; F04B 49/035
(52) U.S. Cl. ..... 60/592; 92/86
(58) Field of Search ..... 92/98 R, 86; 417/383, 417/395; 60/592

(56) References Cited

U.S. PATENT DOCUMENTS 4,430,048 A * 2/1984 Fritsch ..... 92/98 R
4,865,528 A * 9/1989 Fritsch et al. ..... 417/388
5,246,351 A * 9/1993 Horn et al. ..... 417/387
5,655,894 A * 8/1997 Fritsch ..... 417/387

FOREIGN PATENT DOCUMENTS

DE 37 08 868 A1 10/1988
DE 44 20 863 A1 12/1995

* cited by examiner

*Primary Examiner*—Edward K. Look
*Assistant Examiner*—Thomas E. Lazo
(74) *Attorney, Agent, or Firm*—McCormick, Paulding & Huber LLP

(57) ABSTRACT

In diaphragm compressors diaphragm heads with oil spaces of high energy content (pressure×volume) have a strongly negative influence on the operating response of the oil overflow valve. The reaction of the valve leads to undesirably long open times causing more oil to flow out than brought in by an oil compensation pump, and causing many strokes to occur during which the diaphragm is no longer moved to its dead point. Accordingly not all compressed gas is pushed out of the compressor, which is connected with a rapid lowering of the suction efficiency. This problem is solved by the invention in that a throttle mechanism is arranged inside or outside of the oil space which lowers the oil pressure inside of the conductor to the oil overflow valve during the process in question and creates a constant differential pressure within the viscosity band of the oil.

5 Claims, 4 Drawing Sheets

METHOD AND APPARATUS FOR MAINTAINING THE CORRECT OIL OVERFLOW QUANTITY IN DIAPHRAGM COMPRESSORS

CROSS REFERENCE TO RELATED APPLICATION

Applicant hereby claims foreign priority benefits under 35 U.S.C. §119 of German Application No. 100 56 568.9, filed Nov. 15, 2000, the disclosure of which is herein incorporated by reference.

BACKGROUND OF THE INVENTION

The invention concerns a method and an apparatus for maintaining the correct oil overflow quantity in diaphragm compressors.

Diaphragm compressors work similarly to normal piston compressors, but with a separating diaphragm between the gas side and the oil side. The oil side is made as the usual piston-cylinder unit, whose working and dead volumes are entirely filled with oil. On the gas side are gas suction and pressure outlet valves. By the oscillating movement of the piston a displaced volume is transmitted to the diaphragm, which then on its other side takes on the suction, the compression and the expelling of the gas. Since the oil pressure during all of the strokes of the suction and compression process corresponds to the course of the pressure on the gas side, one can talk here about the operation of a piston compressor.

A small difference in comparison to piston compressors however exists in that in diaphragm compressors a secondary oil circuit has to be installed in order to compensate for the leakage oil of the piston. For this purpose a compensation pump, driven by an eccentric cam on the crankshaft, is used. This pump sprays a small amount of oil into the oil space of the compressor synchronously with each piston stroke. This amount of oil must theoretically be exactly of the same size as the leakage at the compressor piston. Since this is not technically realizable, a sprayed in amount of oil is always used which is larger than the leakage. This has in turn the result that with each stroke of the compressor piston somewhat too much oil is contained in the oil space which then in the forward dead point of the diaphragm (=engaging the cover) leads to an uncontrollable oil pressure increase. To avoid this there must also be provided an oil overflow valve which limits the oil pressure at the forward dead point of the piston to a value which is slightly more than the maximum pressure of the gas.

The spring loaded oil overflow valve, which works as a safety valve, dare however let out only an amount of oil which is actually the excess amount entering the oil space from the compensation pump. This amount, which is let out with each stroke, is on one hand dependent on the opening characteristic of the oil overflow valve, for which the construction of the seat part and the spring characteristics are contributing elements, and on the other hand the energy content of the oil space (pressure×volume) has a strong influence on the responsiveness of the oil overflow valve.

The latter leads to undesirably long open times of the oil overflow valve during which more oil is let out than supplied by the compensation pump. This has then the result that in many strokes the diaphragm is no longer moved to its dead point. Accordingly not all of the compressed gas is exhausted, which is connected with a rapid decline of the suction efficiency.

The diaphragm pump described in DE 44 20 863 A1 has the described oil space with inlet and outlet conductors to an oil reservoir, wherein oil overflow valves are arranged in the inlet and outlet conductors which compensate for the oil loss in the oil space.

SUMMARY OF THE INVENTION

The object of this invention is to provide a method and apparatus whereby the too long open times of the oil overflow valve at different operating conditions of the oil space are avoided.

This object is solved in that in the outlet conductor in front of the oil overflow valve, with respect to the flow direction, is arranged a control valve with a throttle restriction, and in that the control valve in dependence on the differential pressure at the throttle restriction is so controlled that upon an increasing differential pressure an opening of the control valve is made free, through which opening an additional amount of oil then flows to the oil reservoir.

An advantageous elaboration of the invention is given in the claims.

BRIEF DESCRIPTION OF THE DRAWINGS

An exemplary embodiment of the invention is illustrated in the drawings and is described in more detail hereinafter.

DESCRIPTION OF THE PREFERRED EMBODIMENTS

Figure 1:
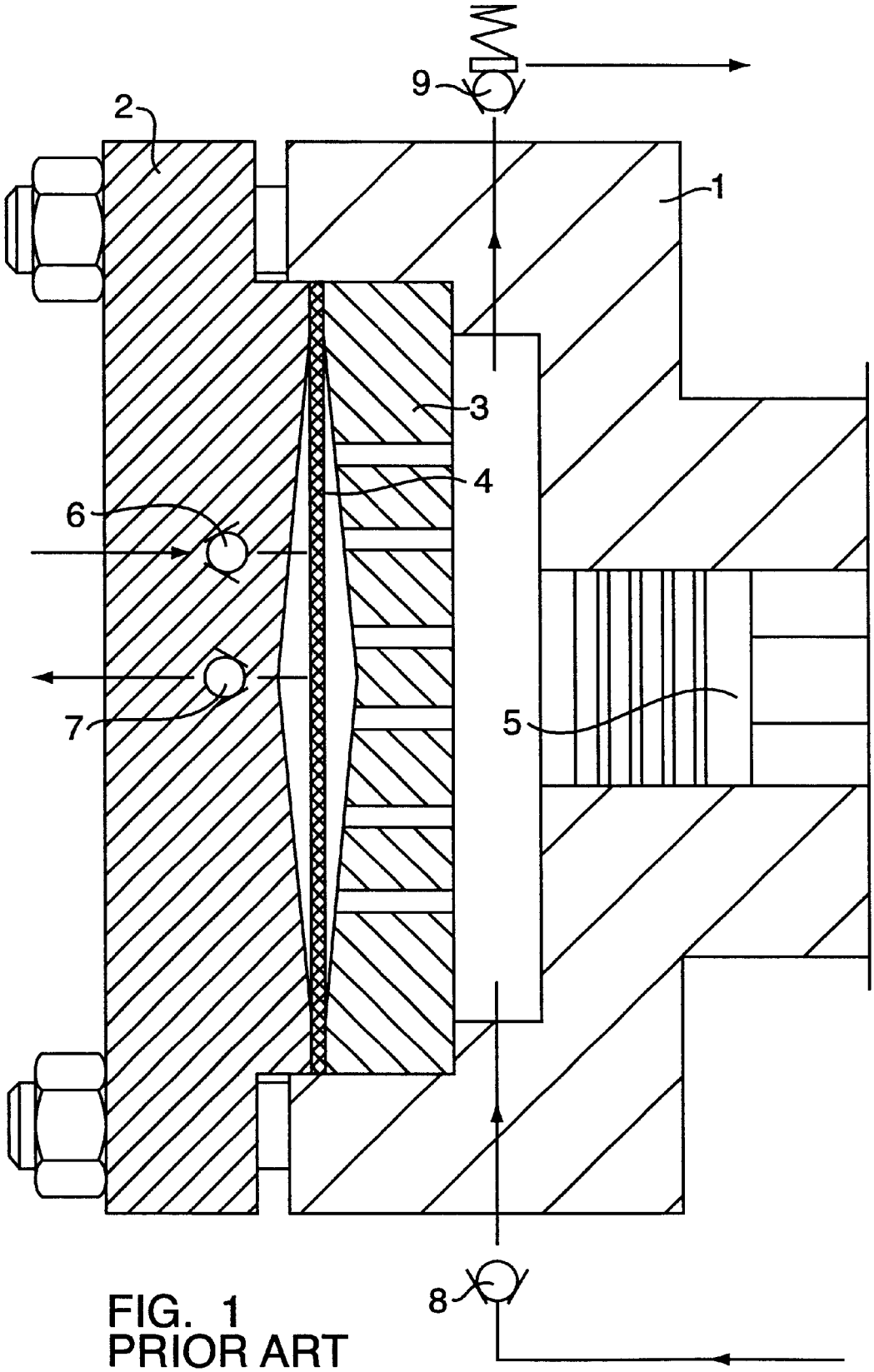
FIG. 1 PRIOR ART
FIG. 1 shows a complete diaphragm head in a construction according to the state of the art.

In accordance with FIG. 1, the main components of a diaphragm compressor are a flange with a cylinder 1, a cover 2, an aperture plate 3, a diaphragm 4, a piston 5, a suction valve 6, a pressure valve 7 a check valve 8, and an oil overflow valve 9. The volume designated as oil space extends between the piston 5 and the diaphragm 4. The volume designated as gas space extends from the diaphragm 4 to the cover 2. The diaphragm stroke volume is determined by the piston stroke volume (surface×stroke), so that the effect is that of a piston compressor. The diaphragm moves in volume synchronism with the piston, sucking in gas through the suction valve 6, compressing it and expelling it through the pressure valve 7.

The oil leakage at the piston 5 must be compensated for by an external pump. For this a small eccentric cam driven piston pump is used which with each stroke sprays a small amount of oil into the oil space through the check valve 8. Therefore, since the eccentric cam is located directly on the crankshaft, with each stroke of the main piston 5 a precisely dosed injection by the compensation pump occurs in synchronism with each stroke of the main piston 5. Since this injected amount of oil, to assure proper operation, must always be greater than the leakage at the piston 5, an oil overflow valve 9 is also necessary which allows the excess amount of injected oil to escape at the forward dead point of the piston 5 and diaphragm 4.

The amount of oil relieved through the oil overflow valve dare not be larger than the surplus portion of oil in the oil space. Especially in the case of oil spaces with a high energy content, that is with a high product of pressure×oil volume, it often happens that the open times of the oil overflow valves become too long so that the valves then let out too high quantities of oil.

Figure 2:
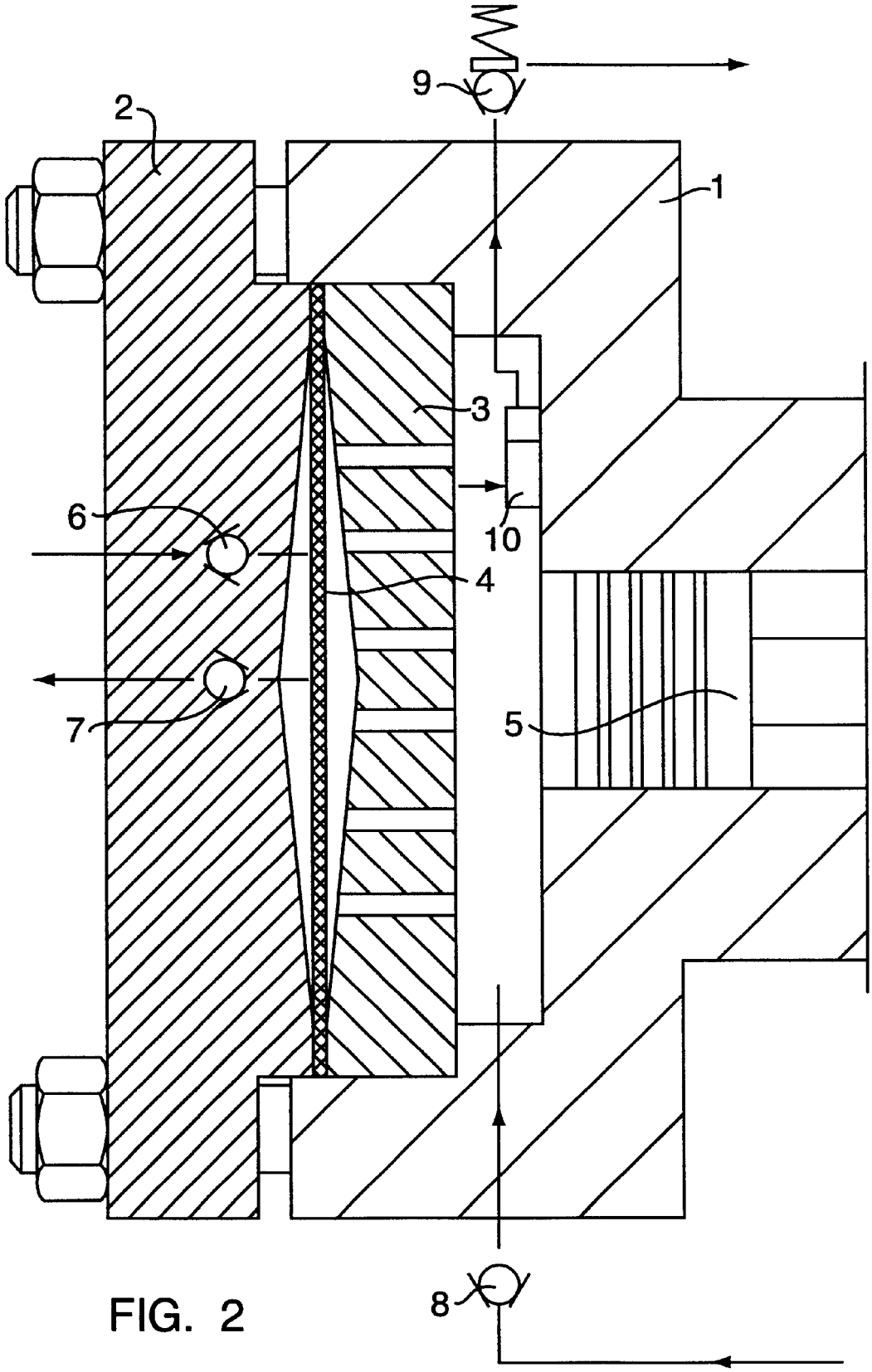
FIG. 2 shows a complete diaphragm head according to FIG. 1 and which additionally has an apparatus according to the invention included inside of the oil space.
Figure 3:
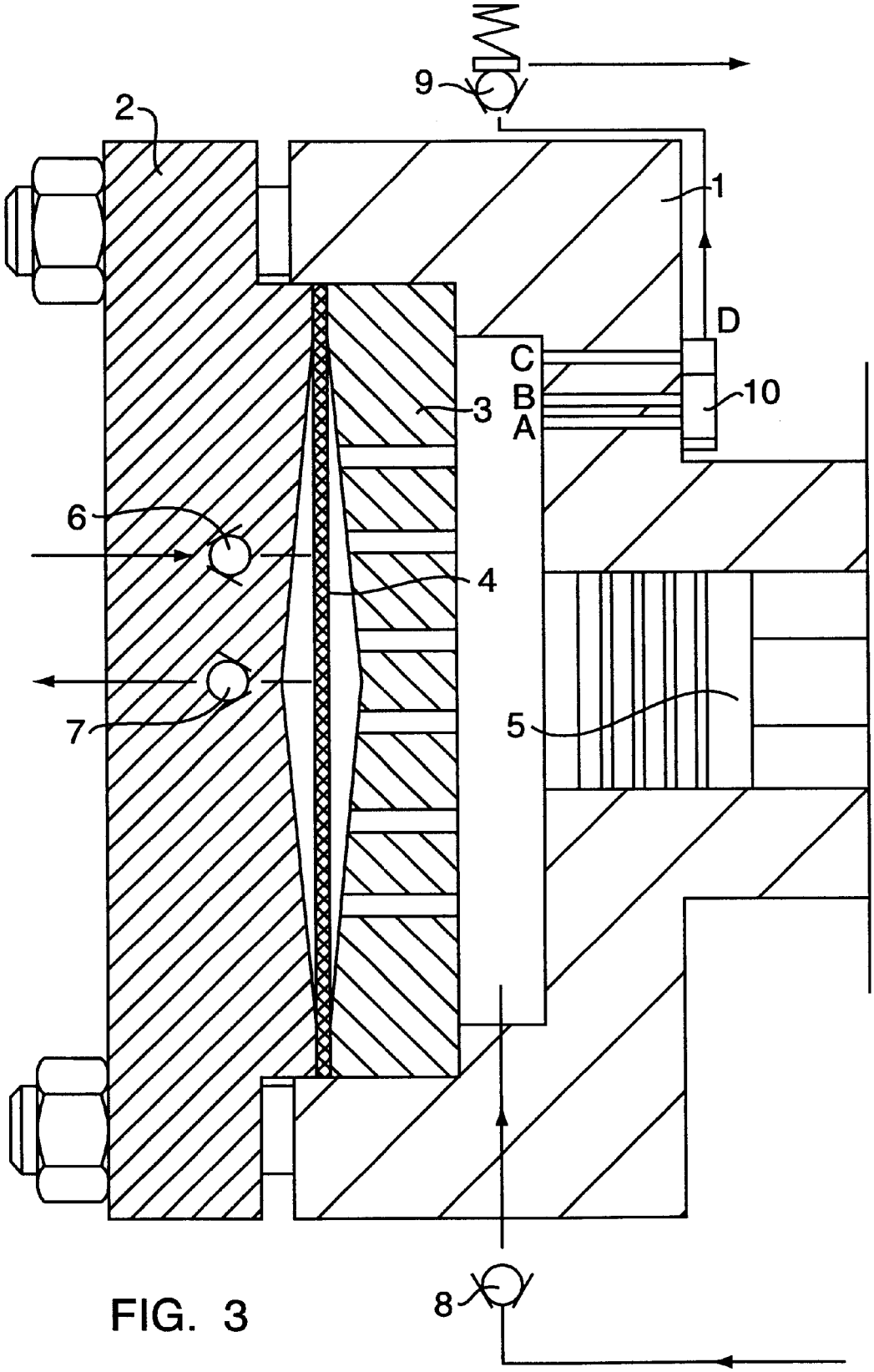
FIG. 3 shows a complete diaphragm head according to FIG. 1 and which additionally includes an apparatus according to the invention located outside of the oil space.

The additionally included throttling mechanism 10 shown in FIGS. 2 and 3 forms the core of the invention. It has the task of a throttle which functions during the open time of the oil overflow valve to allow the pressure in the conductor to the overflow valve to decrease, so that, especially in the case of a high energy content of the oil space, the valve can quickly enough reclose. Such throttle mechanism, however, only makes sense, if between the throttle and the oil overflow valve a sufficiently large buffer volume is arranged in the form of a tubular conductor. Therefore, the throttle mechanism works with a constant throttle portion and a variable throttle portion, which in the case of different oil viscosities assures a constant differential pressure during the valve open time. In particular, in the case of a cold started machine the oil is substantially thicker than in the case of a machine which has already been in used for several hours or days. Therefore a throttle mechanism which takes into consideration this difference is of high utility.

Figure 5:
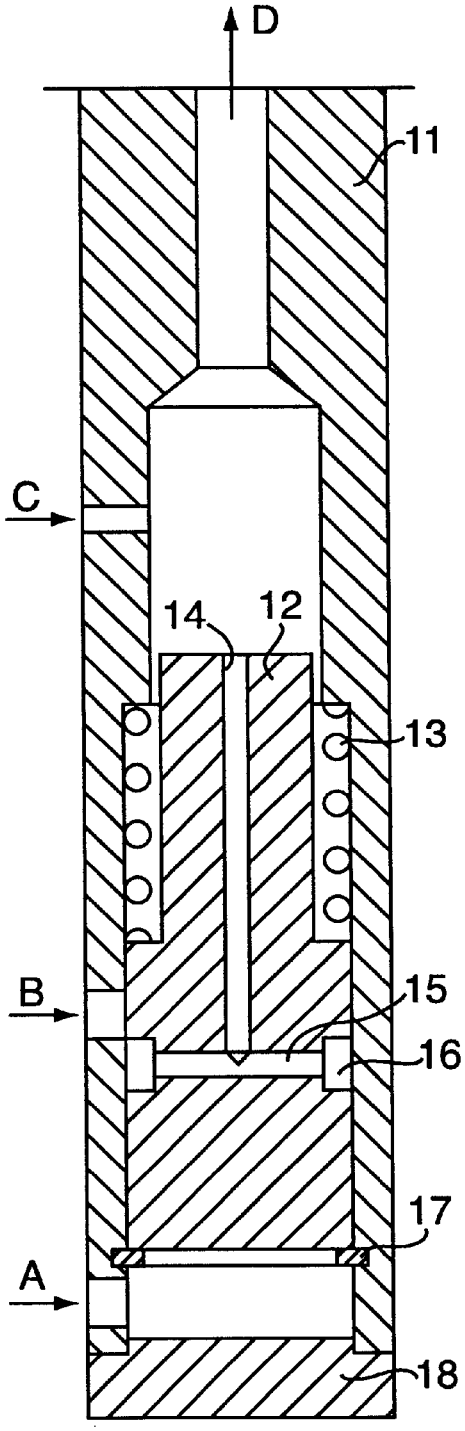
FIG. 5 shows the apparatus of the invention in longitudinal section in its arrangement outside of the oil space.

The throttling mechanism shown in FIG. 5, which is positioned completely in the oil space, has essentially as the real throttling bore in the oil inlet C and the oil outlet D, which is connected by a tubular conductor directly with the inlet of the oil overflow valve. In connection with this it is important that this portion of the pressure path of the oil space is isolated. In this mentioned combination there is a constant throttling, which becomes lower with lower oil viscosity; and with higher viscosity as customary during cold starts, too high differential pressures are created and accordingly too little oil overflows. However, inadmissible high pressures are created inside the diaphragm head.

The slide 12 arranged inside of the housing 11 effects, in cooperation with the spring 13, precompressed by the securing ring 17, and the lower free opening A an upward shiftability of the slide in the event the pressure above the slide strongly diminishes. The differential pressure between the oil space and the location of the oil overflow valve in this arrangement is zero when the valve is closed. Upon the opening of the valve if the pressure inside of the conductor to the oil overflow valve diminishes, as a result of the throttling, a differential pressure is formed across the spring pretension. As soon as the pressure above the slide, which corresponds to the pressure below the location of the oil overflow valve, falls sharply, the slide 12 is pushed by the occurring higher differential pressure further upwardly and thereby makes free a wider oil bypass, through which additional oil can then gain access to the conductor to the oil overflow valve. This additional oil bypass is formed by the inlet opening B, the circumferential groove 16 in the slide, the crossbore 15 and the longitudinal bore 14. Therefore, the variable cross-section portion of the throttle grows with larger values of differential pressure. Also conceivable is a construction in which the two inlet openings B, C are merged to one opening B. In this case the pusher must already in its lower dead position make free a portion of the cross-section of the inlet B.

Figure 4:
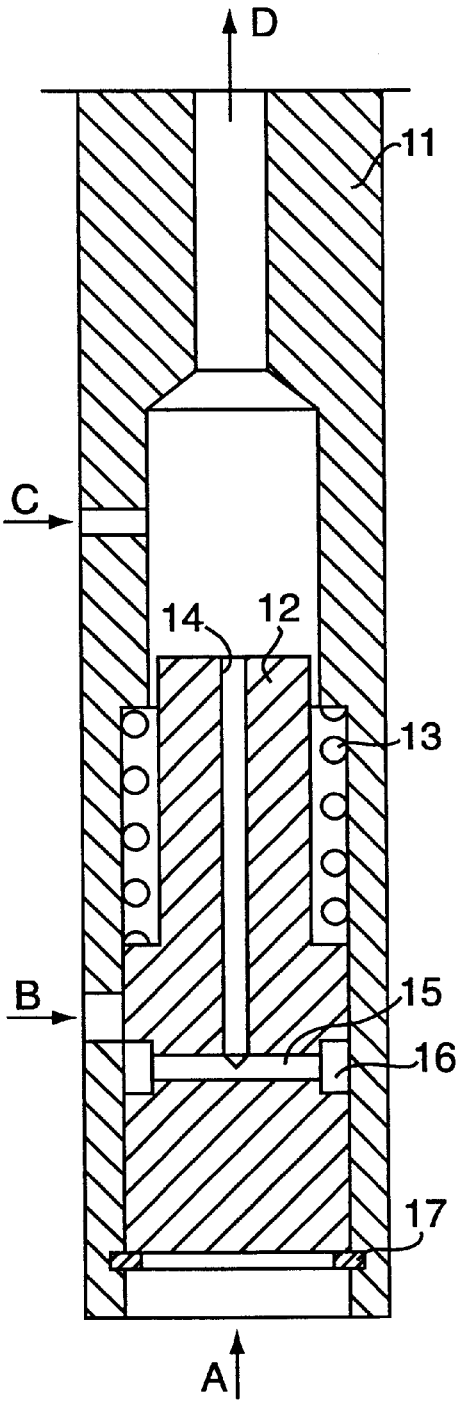
FIG. 4 shows the apparatus of the invention in longitudinal section in its arrangement inside of the oil space.

The throttle mechanism illustrated in FIG. 5 is one having a construction for mounting outside of the oil space. In this case all inlet openings A, B, C are connected with the oil space by channels outwardly sealed by O-rings. Further included is a cover 18 which seals the oil inlet A from the external environment. The functioning of the throttle mechanism therefore remains the same as in the example of the throttle mechanism arranged inside of the oil space as described in connection with FIG. 4.

What is claimed is:

1. An apparatus for controlling an hydraulically driven diaphragm compressor, with an oil space associated with the diaphragm, the oil content of which oil space is to be held constant and which oil space is connected with an oil reservoir by inlet and outlet conductors, which conductors have oil overflow valves, respectively, characterized in that a control valve with a throttle restriction is arranged in the outlet conductor in advance of the overflow valve with respect to the direction of oil flow, and in that the control valve is controlled in dependence on a differential pressure associated with throttle reduction so that in the case of a rising differential pressure an opening of the control valve is made free through which the additional amount of oil flows to an oil reservoir.

2. An apparatus according to claim 1, further characterized in that the pressure difference between the operating pressure applied to the oil overflow valve and the pressure of the oil inside of the inlet conductor remains constant during the operation of the oil overflow valve.

3. An apparatus according to claim 1, characterized by a housing positioned in the oil space of the control valve with an oil outlet opening, to which opening a conductor is connected which is sealed from the oil space and which leads directly to the inlet of the oil overflow valve, the sealed conductor having oil inlet openings and for the purpose of applying differential pressure to a slide, with a pressure maintaining spring for setting a differential pressure, an oil inlet opening, through which opening the compensating oil flows upon the occurrence of high differential pressures, through a circumferential groove, a crossbore, and a longitudinal bore of a slide in the conductor.

4. An apparatus according to claim 3, further characterized in that the housing is located outside of the oil space.

5. An apparatus according to claim 3, characterized by a variable cross-section in the vicinity of the oil inlet opening and the slider groove for holding constant the differential pressure between the oil space and the conductor to the oil overflow valve.

* * * * *